US007997515B2

(12) United States Patent
Freda

(10) Patent No.: US 7,997,515 B2
(45) Date of Patent: Aug. 16, 2011

(54) SELF-CONTAINED ROLL-OFF SHREDDING COMPACTOR SYSTEM

(76) Inventor: Robert B. Freda, Manalapan, NJ (US)

( * ) Notice: Subject to any disclaimer, the term of this patent is extended or adjusted under 35 U.S.C. 154(b) by 0 days.

(21) Appl. No.: 12/703,724

(22) Filed: Feb. 10, 2010

(65) Prior Publication Data

US 2010/0308138 A1 Dec. 9, 2010

Related U.S. Application Data

(63) Continuation of application No. 12/201,012, filed on Aug. 29, 2008, now abandoned.

(51) Int. Cl.
*B02C 19/00* (2006.01)

(52) U.S. Cl. ..... 241/100; 241/101.2; 241/101.78

(58) Field of Classification Search ..... 241/100, 241/101.2, 236, 101.78, 101.76
See application file for complete search history.

(56) References Cited

U.S. PATENT DOCUMENTS

| | | | | |
|---|---|---|---|---|
| 2,691,338 | A | | 10/1954 | Robbins |
| 2,961,977 | A | | 11/1960 | Coleman |
| 3,250,414 | A | | 5/1966 | Pioch |
| 3,318,231 | A | | 5/1967 | Felts |
| 3,467,268 | A | | 9/1969 | Corompt |
| 3,554,120 | A | | 1/1971 | Liberman et al. |
| 3,575,103 | A | | 4/1971 | Charles |
| 3,752,063 | A | | 8/1973 | Golde |
| 3,754,498 | A | | 8/1973 | Gil |
| 3,880,072 | A | | 4/1975 | Ord |
| 3,881,407 | A | | 5/1975 | Goar |
| 3,882,770 | A | | 5/1975 | Bleasdale |
| 3,991,668 | A | | 11/1976 | De Milt et al. |
| 4,096,956 | A | | 6/1978 | Gaskin |
| 4,102,263 | A | | 7/1978 | Forsberg |
| 4,121,514 | A | | 10/1978 | Nickaloff |
| 4,121,515 | A | | 10/1978 | Tea |
| 4,201,128 | A | | 5/1980 | Whitehead et al. |
| 4,235,165 | A | | 11/1980 | Fenner et al. |
| 4,643,087 | A | | 2/1987 | Fenner et al. |
| 4,662,317 | A | | 5/1987 | Ogawa |
| 4,768,432 | A | | 9/1988 | Storlie |
| 4,829,895 | A | | 5/1989 | Juhuku |
| 4,860,646 | A | | 8/1989 | Spiers |
| 5,001,978 | A | | 3/1991 | Discepolo |
| 5,044,270 | A | * | 9/1991 | Schwelling ..... 100/353 |
| 5,064,126 | A | | 11/1991 | Hickey et al. |
| 5,139,205 | A | | 8/1992 | Gallagher et al. |
| 5,155,975 | A | | 10/1992 | Knowler |

(Continued)

OTHER PUBLICATIONS

DRC II Dual Recycling Compactor Brochure MP-3M-3/04, Marathon Equipment Company, © 1991, 4 Pages.

(Continued)

*Primary Examiner* — Mark Rosenbaum
(74) *Attorney, Agent, or Firm* — Wendelsohn, Drucker & Associates, P.C.; David L. Cargille; Steve Mendelsohn

(57) ABSTRACT

The present invention provides an improved system and method for on-site document shredding, through the use of a self-contained roll-off compactor including a high-volume shredder. This self-contained roll-off shredding compactor permits users to collect, shred, compact and temporarily store the shredded confidential documents, using their own personnel in a cost-effective manner. A waste management service provider periodically picks up, transports and empties the roll-off shredding compactors. In a preferred embodiment, the roll-off shredding compactor is owned by the waste management service provider and leased to the user.

16 Claims, 5 Drawing Sheets

U.S. PATENT DOCUMENTS

| | | | | |
|---|---|---|---|---|
| 5,178,062 | A | | 1/1993 | Spiers |
| 5,297,481 | A | | 3/1994 | Robbins et al. |
| 5,348,125 | A | | 9/1994 | Stribling |
| 5,395,061 | A | | 3/1995 | Merklinger |
| 5,415,086 | A | | 5/1995 | Robbins |
| 5,447,017 | A | | 9/1995 | Becher et al. |
| 5,513,804 | A | | 5/1996 | Keeler et al. |
| 5,516,050 | A | | 5/1996 | Yamamoto et al. |
| 5,542,617 | A | * | 8/1996 | Rajewski ..... 241/101.761 |
| 5,575,201 | A | | 11/1996 | Fenner et al. |
| 5,579,684 | A | | 12/1996 | Stribling |
| 5,622,320 | A | | 4/1997 | Hubbard et al. |
| 5,752,439 | A | | 5/1998 | LaMora, Jr. |
| 5,871,162 | A | | 2/1999 | Rajewski |
| 5,873,304 | A | | 2/1999 | Ruf |
| 5,941,468 | A | | 8/1999 | Lewis et al. |
| 5,960,710 | A | | 10/1999 | Holtom |
| 6,055,902 | A | | 5/2000 | Harrop et al. |
| 6,158,336 | A | | 12/2000 | Cambiano |
| 6,332,746 | B1 | | 12/2001 | Lang et al. |
| 6,491,245 | B1 | | 12/2002 | Rajewski |
| 6,520,072 | B2 | | 2/2003 | Chedru et al. |
| 6,588,330 | B1 | | 7/2003 | Importico |
| 6,588,691 | B2 | | 7/2003 | Yamamoto et al. |
| 6,935,586 | B1 | | 8/2005 | Janssen |
| 7,011,018 | B2 | | 3/2006 | Schroeder et al. |
| 7,077,344 | B2 | | 7/2006 | Starlinger-Huemer et al. |
| 7,150,422 | B2 | | 12/2006 | Wang |
| 7,198,213 | B2 | | 4/2007 | Kolbet et al. |
| 7,258,294 | B1 | | 8/2007 | Ralicki |
| 7,314,002 | B2 | | 1/2008 | Dupuis |
| 2004/0129810 | A1 | | 7/2004 | Kasprowicz et al. |
| 2005/0051650 | A1 | | 3/2005 | Watanabe |
| 2006/0151647 | A1 | | 7/2006 | Easton et al. |
| 2006/0219826 | A1 | | 10/2006 | Yamamoto |
| 2006/0219831 | A1 | | 10/2006 | Yamamoto |

OTHER PUBLICATIONS

Mini-MAC® Marathon Apartment Compactor Brochure SP-3M-Jun. 2007, Marathon Equipment Company, © 2000, 2 pages.

Schematic drawing of the Mini-MAC® , Marathon Equipment Company, ©2003, 1 page.

RJ-250 SC Self-Contained Compactor with 15 to 39 Cubic Yard Capacity Container Brochure SP-3M-Aug. 2007, Marathon Equipment Company, ©1987, 4 pages.

RJ-225 On-Site Compactor Brochure SP-3M-Jun. 2007 , Marathon Equipment Company, © 1991, 2 pages.

Shred-Tech ST-25 Shredder Brochure, Shred-Tech, 2006, 2 pages.

Shred-Tech ST-100H Roll-Off Shredder Brochure, Shred-Tech, 2006, 1 page.

VIP Vert-I-Pack Self-Contained Compactor/Containers Brochure SP-3M-Sep. 2007, Marathon Equipment Company, © 1994, 4 pages.

"Home." Shred-Tech: Reduction Systems & Shredding Trucks. http://www.shred-tech.com (Jan. 13, 2008).

"Equipment Options—Hoppers." Marathon Equipment. http://www.marathonequipment.com/options5.htm. (circa Jan. 13, 2008).

"Dual Recycling Compactor—DRC." Marathon Equipment. http://www.marathonequipment.com/sc-drc.htm. (circa Jan. 13, 2008).

"RamJet Stationary Industrial Waste Compactors." Marathon Equipment. http://www.marathonequipment.com/ramjet. (circa Jan. 13, 2008).

"RJ-250 HT Self-Contained Compactor/ Container with Hydraulic Tailgate." Marathon Equipment. http://www.marathonequipment.com/sc-rj250ht.htm (Jan. 13, 2008).

"Apartment & High Rise Waste Compactors." Marathon Equipment. http://www.marathonequipment.com/highri (circa Jan. 13, 2008).

"RJ-250SC Self Contained Compactor." Marathon Equipment. http://www.marathonequipment.com/sc-rj250sc.htm (Jan. 13, 2008).

Shred-Tech Single Rotor Shredders Brochure, Shred-Tech, Mar. 8, 2004, 4 pages.

Shred-Tech Four Shaft Industrial Shredders Brochure, Shred-Tech, 2006, 4 pages.

Shred-Tech MDS-25GTX Brochure, Shred-Tech, 2006, 2 pages.

Shred-Tech Dual Shaft Industrial Shredders, Shred-Tech, 2006, 4 pages.

* cited by examiner

SELF-CONTAINED ROLL-OFF SHREDDING COMPACTOR SYSTEM

FIELD OF THE INVENTION

The present invention relates to self-contained roll-off waste compaction systems.

BACKGROUND

With the increasing incidence of identity theft and other misuse of private or proprietary information, the desirability and necessity of protecting such information is becoming increasingly important. In recent years, laws have been passed in various jurisdictions regulating the use and protection by businesses, health care providers, and other entities, of sensitive or private information on customers, patients, and the like. At the federal level in the United States, the HIPAA and Gramm-Leach-Bliley laws require specific measures, such as document shredding, in order to comply with the laws' provisions for protecting certain designated types of information.

Discarding sensitive documents in an unshredded state is risky, because identity thieves, investigative journalists, and other unscrupulous individuals often engage in "dumpster diving" to retrieve documents from trash dumpsters or garbage cans. Accordingly, the demand for document shredding has surged. For entities having a small amount of documents requiring shredding, personal-sized shredders that are purchased or leased may be adequate. However, for many businesses and other organizations, the large volume of documents and other materials to be shredded makes such an approach impractical. Accordingly, document-shredding service providers have arisen to meet the increasing demand for large-volume shredding.

In the early history of document-shredding services, typically the documents to be shredded were picked up by the service provider and transported to a central facility for shredding. This form of shredding service is still prevalent today. Central document shredding certainly can accomplish its intended purpose, if carried out properly. The drawbacks to central shredding include the necessity of strictly safeguarding the documents against theft or unauthorized access throughout the entire chain of custody from the time the documents are picked up from the customer to the time they are shredded, the necessity of properly documenting the chain of custody and the measures taken to safeguard the documents, and the fact that the users cannot independently verify that the documents were in fact shredded. This latter factor can give rise to a general sense of unease among some users of central shredding services.

Consequently, there is now a trend toward on-site document shredding using mobile shredders. A mobile shredder generally consists of a truck having a shredder mounted therein, and a storage volume for storing the shredded material. Typically, the users place the materials to be shredded in bins or "toters" that usually have wheels for rolling the bins to a location for pickup, such as a curbside location on a street. Mobile shredders typically have some type of bin lift and dump unit, such as those commonly employed on garbage collection trucks, for lifting the bins and emptying them into the shredder. Mobile shredding, however, also has certain drawbacks, including high labor costs, frequent pickups, high fuel costs, high truck maintenance costs, and security issues arising from delays in shredding confidential documents.

What is needed, therefore, is an efficient, low-cost alternative to the industry-standard techniques of central-facility shredding and mobile on-site document shredding.

SUMMARY OF THE INVENTION

The present invention provides an improved system and method for on-site document shredding, through the use of a self-contained roll-off compactor including a high-volume shredder. This self-contained roll-off shredding compactor permits users to collect, shred, compact and temporarily store the shredded confidential documents, using their own personnel in a cost-effective manner. A waste management service provider periodically picks up, transports and empties the roll-off shredding compactors. In a preferred embodiment, the roll-off shredding compactor is owned by the waste management service provider and leased to the user.

Thus, in accordance with one embodiment of the invention, there is provided a roll-off shredding compactor suitable for transport by a transport vehicle, comprising: a roll-off base having at least one wheel; a compaction unit mounted on the roll-off base, including a compaction chamber having an upper opening for receiving waste and a horizontal opening for ejecting compacted waste; a waste storage compartment mounted on the roll-off base and having a horizontal opening for receiving compacted waste ejected from the compaction chamber; and a shredder unit connected to the compaction unit such that shredded waste passes through the upper opening of the compaction unit into the compaction chamber.

In another embodiment of the invention, there is provided a method of operating a self-contained roll-off shredding compactor having a roll-off base, a shredding unit including a shredder motor, a compaction unit having a hydraulic ram and including a compaction chamber, and a waste storage compartment. The method comprises the steps of: activating the shredder motor in the shredder unit, such that waste that is inserted into the shredder unit is shredded by the shredder unit and deposited into the compaction chamber; deactivating the shredder motor; and cycling the hydraulic ram in the compaction unit to compact the shredded waste and eject the compacted waste into the waste storage compartment.

In yet another embodiment of the invention, there is provided a method of providing document destruction services to a user having confidential documents to be destroyed. The method comprises: (a) leasing a roll-off shredding compactor to the user; (b) delivering the roll-off shredding compactor to a site designated by the user; and (c) periodically picking up the roll-off shredding compactor at the designated site, emptying its contents, and returning it to the designated site

BRIEF DESCRIPTION OF THE DRAWINGS

Figure 1:
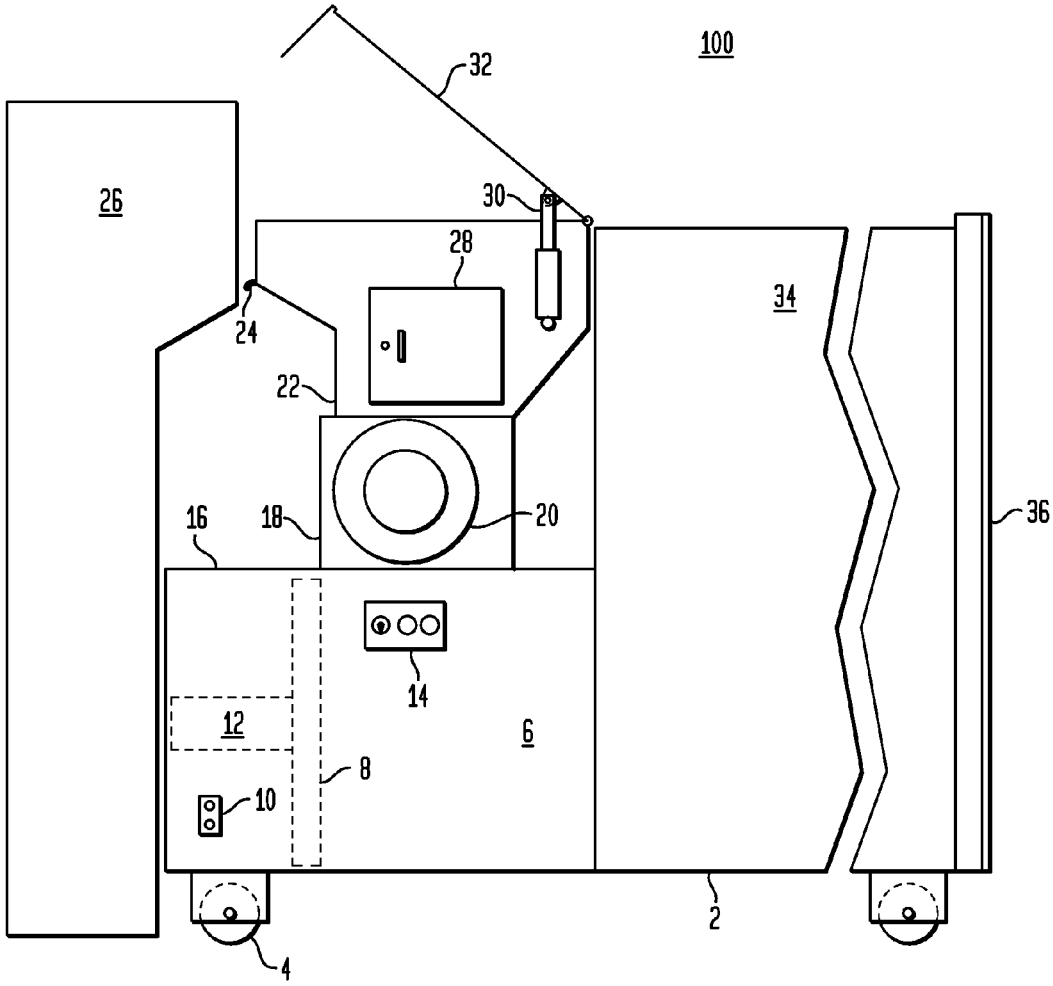
Figure 2:
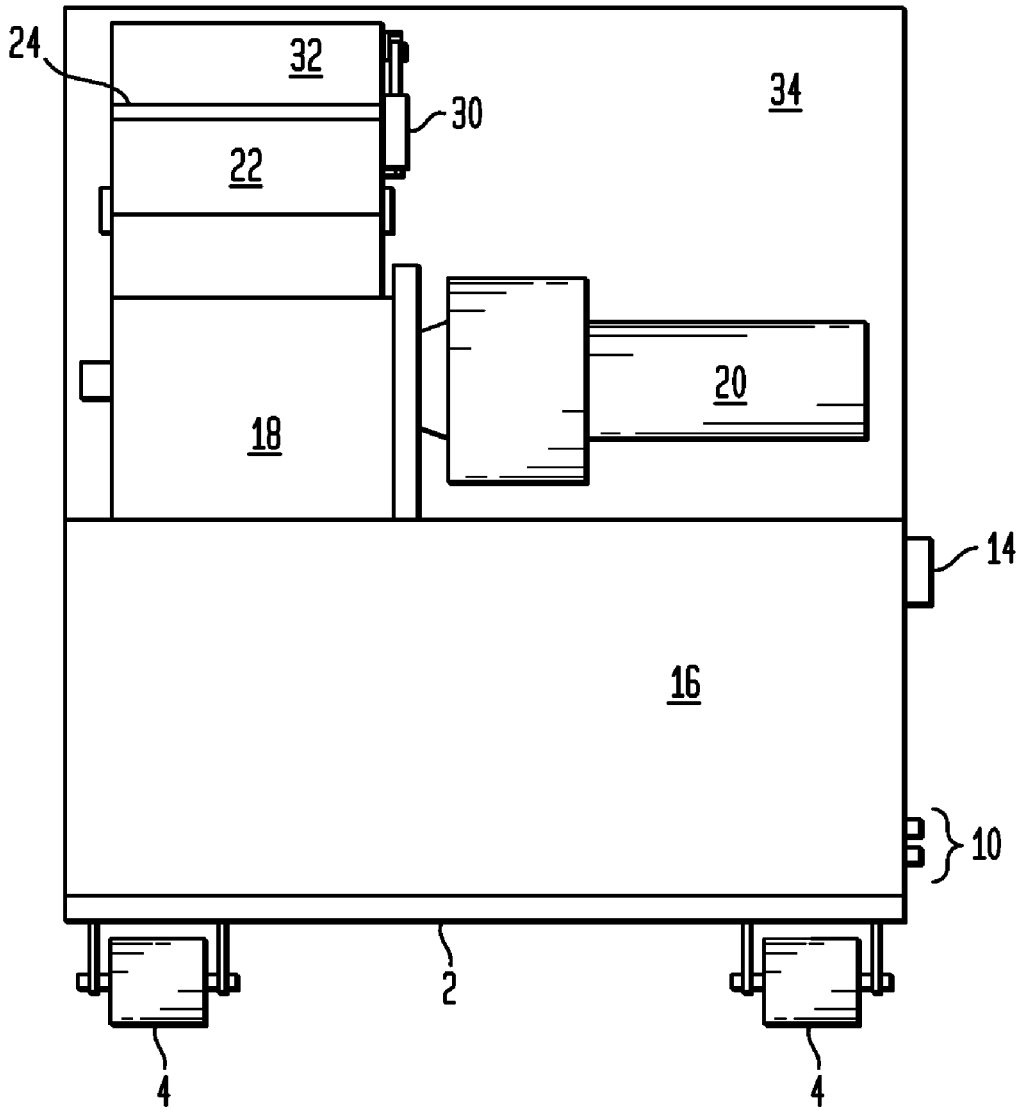
Figure 3:
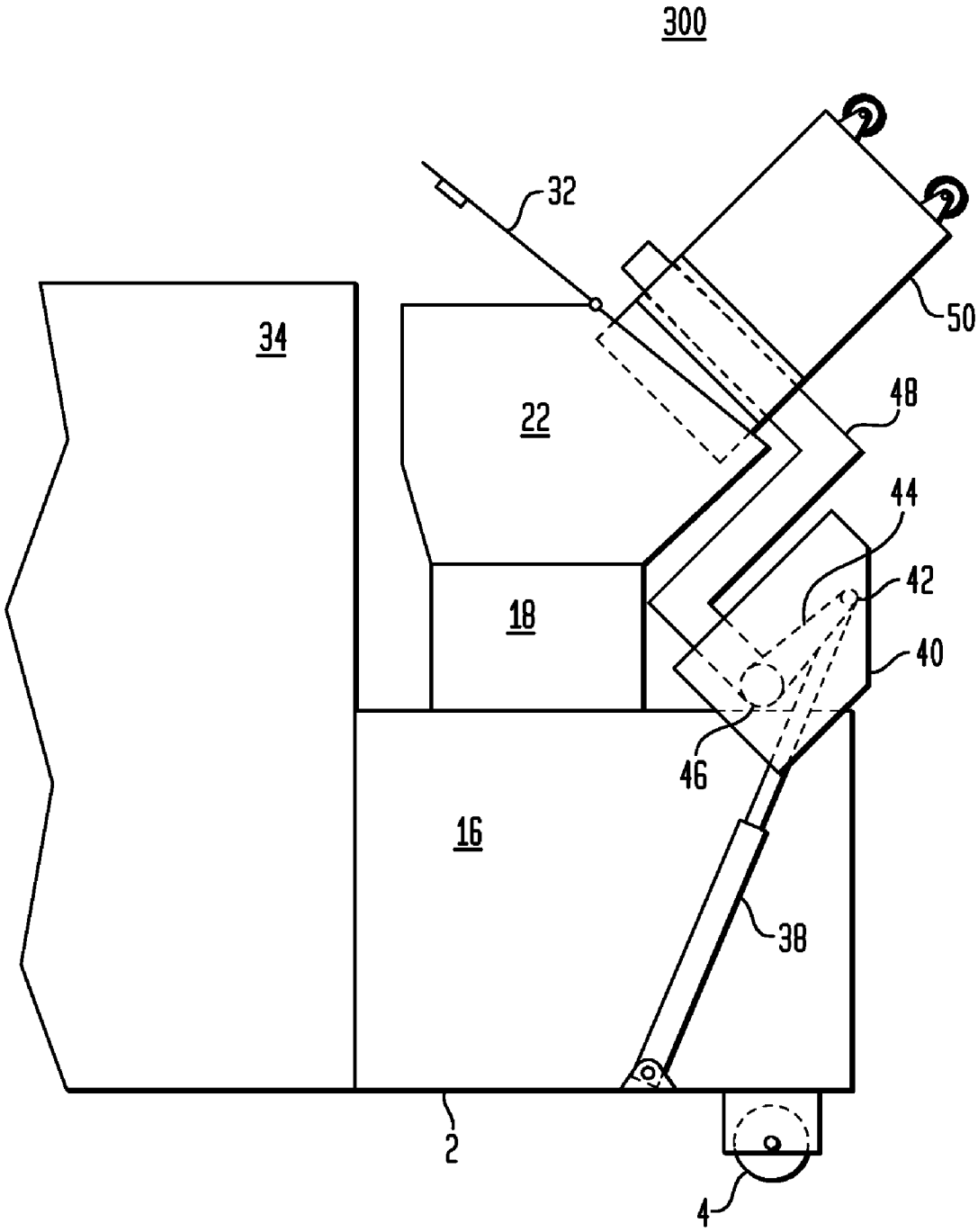
Figure 4:
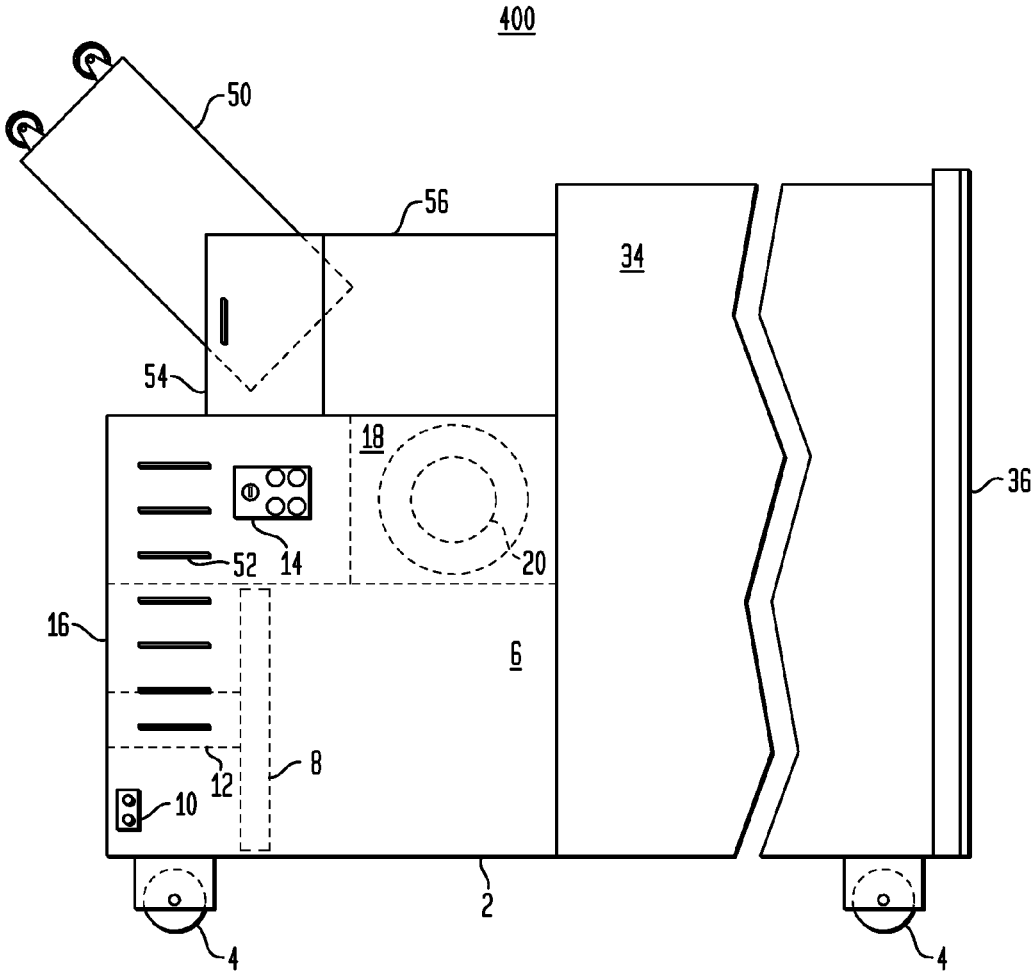
Figure 5:
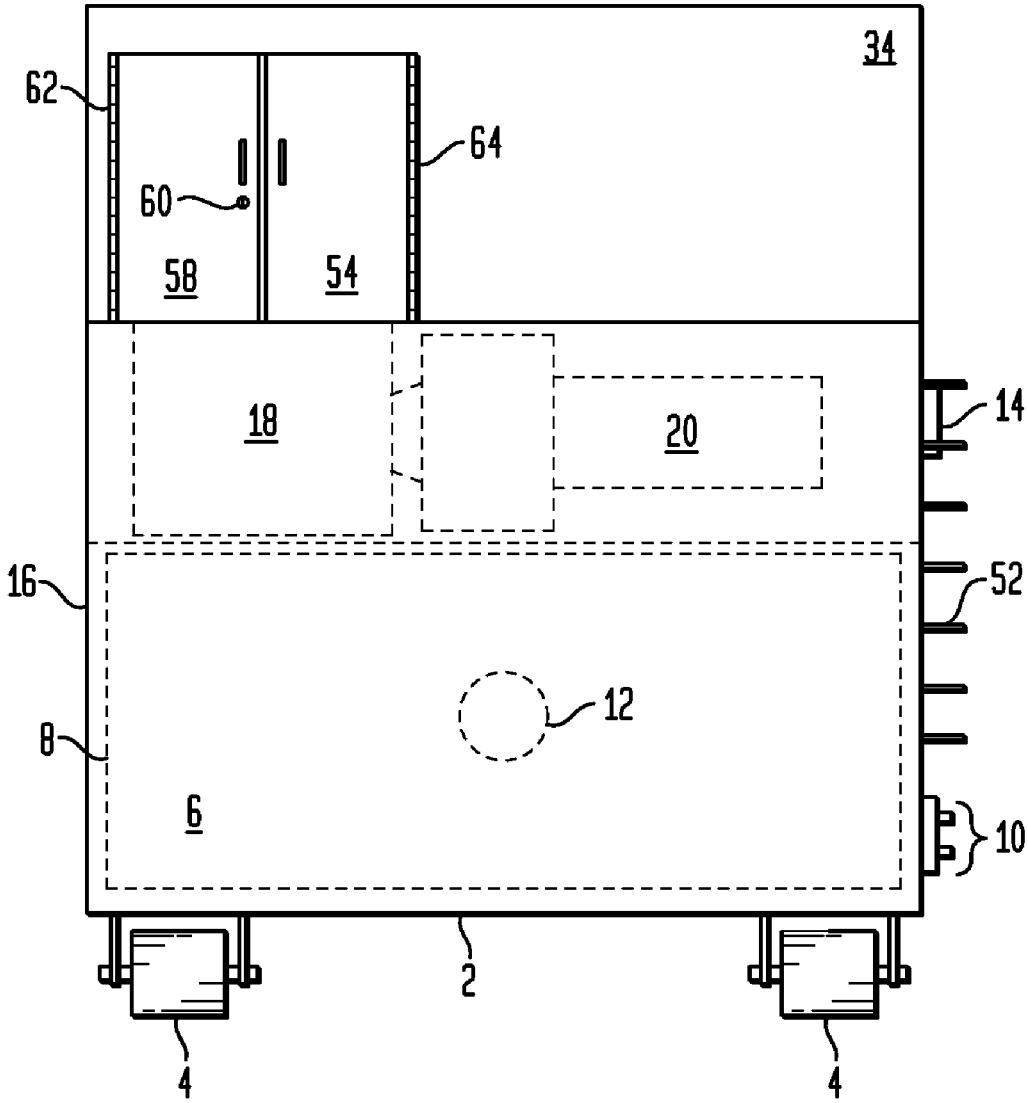

Having thus described the invention in general terms, reference will now be made to the accompanying drawings, which are not necessarily drawn to scale, and wherein:

FIG. 1 is a side elevational view of a roll-off shredding compactor in accordance with one embodiment of the invention;

FIG. 2 is a left-end elevational view of the roll-off shredding compactor illustrated in FIG. 1;

FIG. 3 is a side elevational view of a roll-off shredding compactor having an integral bin-lift-and-tip mechanism in accordance with another embodiment of the invention;

FIG. 4 is a side elevational view of a roll-off shredding compactor in accordance with still another embodiment of the invention; and FIG. 5 is a left-end elevational view of the roll-off shredding compactor illustrated in FIG. 4.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

A roll-off shredding compactor 100 in accordance with one embodiment of the invention is depicted in FIGS. 1 and 2. FIG. 1 depicts a side elevational view, and FIG. 2 depicts a left-end elevational view of the embodiment illustrated in FIG. 1. The roll-off shredding compactor 100 comprises a roll-off base 2 including at least one roll-off wheel 4, a compaction unit 16 mounted on the roll-off base 2, a waste storage compartment 34 mounted on the roll-off base 2, and a shredder unit 18. Although roll-off base 2 is described conceptually as a separate component, compaction unit 16 and waste storage compartment 34 may be manufactured as an integral unit. In this case, roll-off base 2 should be construed to include the bottom side of the integral unit including compaction unit 16 and waste storage compartment 34.

The compaction unit 16 includes a compaction chamber 6 having an upper opening for receiving waste and a side opening for ejecting compacted waste. Waste storage compartment 34 has a corresponding side opening for receiving compacted waste ejected from the compaction chamber 6 and at least one door 36 for discharging the compacted material. The shredder unit 18 is connected to the compaction unit such that shredded waste passes through the upper opening of the compaction unit into the compaction chamber.

Shredder unit 18 may include a hopper 22 for receiving and directing waste material into the shredder unit 18. Hopper 22 may be provided with one or more panels 28 to allow access to the top of shredder unit 18 for maintenance purposes. The upper front face and top face of hopper 22 are open to front and to above, respectively, and a lip 24 is provided, upon which a waste container may be rested and tipped into hopper 22. A hopper cover 32 may also be provided to restrict access to the hopper 22 and to the shredder unit 18 when the shredding compactor is not in use. Shredder unit 18 may also include a means for opening and closing the hopper cover, which may include a manual chain or rod-based opening assembly (not shown), or more preferably, a hydraulic or electric actuator 30 or a rotary hydraulic or electric motor (not shown).

The compaction unit 16 preferably includes a horizontally-acting hydraulic piston 12 and compaction platen 8 to compact waste within the compaction chamber and to eject the waste into the waste storage compartment 34. Other piston and platen assemblies may be employed. The platen 8 is movable between a storage position (shown in FIG. 1) and an operating position. In the storage position, the platen 8 is disposed rearward of the upper opening of compaction chamber 6, such that the front face of platen 8 and the side walls of the compaction unit 16 form the compaction chamber 6. Once the hydraulic piston 12 is actuated, the platen 8 advances toward the waste storage compartment 34, thereby directing the waste material in the compaction chamber 6 into the waste storage compartment 34. Compaction unit 16 is preferably capable of providing a total normal force of about 40,000 pounds and a total maximum force of about 50,000 pounds.

The shredder unit 18 is preferably a high-capacity single-shaft rotary shredder having a rotor with rigid cutters and a stationary counter-knife, such as those described in U.S. Patent Application Publication No. US2004/0118958A1 and in European Patent EP 419 919 B1, the entire disclosures of which are incorporated herein by reference. The rotary shredder receives material to be shredded, shreds the material into small flake-like pieces, and passes the shredded material through a screen (not shown) into the compaction chamber 6 for compaction into waste storage compartment 34. The screen has apertures suitably sized to regulate the size of the pieces of shredded material. Shredder unit 18 may be electrically powered or hydraulically powered by shredder drive 20. High-capacity single-shaft rotary shredders and shredder drives suitable for use in the invention are commercially available. For example, shredder unit 18 may be a 25-horsepower shredder, model no. ST-25, available from Shred-Tech, located in Cambridge, Ontario.

The roll-off shredding compactor 100 may further include a pull-out bar connected to the waste storage compartment for receiving a hook of a winch of the transport vehicle, so that the roll-off shredding compactor can be rolled onto the transport vehicle.

A stand-alone bin lift and dump unit 26 may also be provided. Bin lift and dump unit 26 may be any mechanism adapted to receive a waste bin at ground level or at the level of a loading dock, raise the waste bin up to hopper 22, and tip the waste bin so that its contents fall into hopper 22. Suitable bin lift and dump units are known to those of ordinary skill in the art and are commercially available, e.g., from Shred-Tech.

Hydraulic power for the compaction unit 16, shredder drive 20, the hopper cover actuator 30, and the bin lift and dump unit 26 is preferably provided by a remote hydraulic power unit (not shown) connected to hydraulic terminals 10. The remote hydraulic power unit is preferably sized to accommodate simultaneous operation of the shredder drive 20 and the bin lift and dump unit 26. Suitable remote hydraulic power units are known to those of ordinary skill in the art and are commercially available.

Control panel 14 may be provided to control the operation of the roll-off shredding compactor and the bin lift and dump unit 26. Separate controls may be provided for each of the compaction unit 16, the shredder unit 18, hopper cover actuator 30, and the bin lift and dump unit 26. In a preferred embodiment, however, control panel 14 includes a master start control and a master stop control. Activating the master start control may initiate a complete shredding and compacting sequence, which may include: (1) automatically opening the hopper cover 32, e.g., by actuating hopper cover actuator 30; (2) activating the shredder motor 20 in shredder unit 18; (3) cycling the bin lift and dump unit 26 to empty waste in the waste bin into hopper 22, whereupon the waste is shredded by shredder unit 18 and deposited into the compaction chamber 6; (4) cycling the hydraulic ram 12 in compaction unit 16 to compact the shredded waste and eject the compacted waste into waste storage compartment 34; and (5) deactivating shredder motor 20 and automatically closing the hopper cover 32, e.g., by retracting hopper cover actuator 30. In a further embodiment, the control panel may be configured, upon activating the master start control, to activate the bin lift and dump unit 26 a predetermined plurality of times (i.e., for a predetermined number of waste bins), before proceeding to activate the hydraulic ram 12 in compaction unit 16. Control panel 14 may be implemented in electronic or hydraulic form in accordance with known techniques.

FIG. 3 illustrates a roll-off shredding compactor 300 incorporating an integral bin lift and dump unit in accordance with a further embodiment of the invention. The integral bin lift and dump unit depicted in FIG. 3 comprises at least one lift actuator 38, at least one shield member 40, at least one force translation member 44, an axle 46, and at least one bin engaging member 48 adapted to engage a waste bin 50. Lift actuator 38 is connected to the force translation member 44 at a point 42 radially offset from axle 46, and force translation member 44 is connected to axle 46. Finally, bin engaging member 48 is also connected to axle 46, at a point along axle 46 such that waste bin 50 is properly aligned with hopper 22.

When lift actuator 38 is actuated, force translation member 44 causes axle 46 to rotate, which in turn causes bin engaging member 48 and waste bin 50 to rotate around the center of axle 46. In this matter, waste bin 50 is lifted from a first position at ground level to a second position at the intake opening of hopper 22, such that waste in waste bin 50 is discharged into hopper 22. Shield member 40 serves to protect a user's hands from coming into contact with moving parts during operation. In a preferred embodiment, a lift actuator 38 and a force translation member 44 are provided on each side of roll-off shredding compactor 300, and a bin engaging member 48 is provided on each side of the waste bin 50. It should also be understood that other types and configurations of integral bin lift and dump units are known to those of ordinary skill in the art and may be used in roll-off shredding compactor 300.

In FIGS. 4 and 5, another roll-off shredding compactor 400 in accordance with a further embodiment of the invention is depicted. FIG. 4 depicts a side-elevational view, and FIG. 5 depicts a left-end elevational view of the embodiment illustrated in FIG. 4. Like roll-off shredding compactor 100 shown in FIGS. 1 and 2, roll-off shredding compactor 400 in FIGS. 4 and 5 comprises a roll-off base 2 including two or more roll-off wheels 4, a compaction unit 16 mounted on the roll-off base 2, a waste storage compartment 34 mounted on the roll-off base 2, and a shredder unit 18. The compaction unit 16 includes a compaction chamber 6 having an upper opening for receiving waste and a side opening for ejecting compacted waste. Waste storage compartment 34 has a corresponding side opening for receiving compacted waste ejected from the compaction chamber 6. The shredder unit 18 is connected to the compaction unit such that shredded waste passes through the upper opening of the compaction unit into the compaction chamber.

In the embodiment shown in FIGS. 4 and 5, however, the shredder unit 18 and motor 20 are positioned within the enclosure for the compaction unit 16, and a doghouse 56, rather than a hopper, is positioned over the shredder unit 18. Doghouse 56 includes access doors 54, 58, which, when opened, serve as a positioning guide to align waste bin 50 with shredder unit 18 and to guide waste from the waste bin 50 into shredder unit 18. The access doors 54, 58 may be mounted on the doghouse via hinges 62 and 64 shown in FIG. 5. Lock 60 may also be provided to secure access doors 54, 58. Additional access doors (not shown) may also be provided in the enclosure for compaction unit 16 to allow maintenance access to shredder unit 18 and shredder motor 20. Further, ladder steps 52 may be provided on the side of compaction unit 16 to enable easier access to the interior of doghouse 56 and to the top of shredder unit 18. Roll-off shredding compactor 400 may further include a stand-alone or integral bin lift and dump unit as described above with reference to FIGS. 1 and 3.

In a further embodiment, the invention is a method of providing document destruction services to a user (which may include a person or a company) having confidential documents to be destroyed. The method comprises: (1) leasing a roll-off shredding compactor to the user; (2) delivering the roll-off shredding compactor to a site designated by the user; and (3) periodically picking up the roll-off shredding compactor at the designated site, emptying its contents, and returning it (or another roll-off shredding compactor) to the designated site. In a preferred embodiment, the roll-off shredding compactor may include an integral bin lift and dump unit. Alternatively, the method may include selling or leasing a stand-alone bin lift and dump unit to the entity for use with the roll-off shredding compactor.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims.

What is claimed is:

1. A roll-off shredding compactor suitable for transport by a transport vehicle, comprising:

a roll-off base having at least one wheel;

a compaction unit mounted on the roll-off base, including a compaction chamber having an upper opening for receiving waste and a horizontal opening for ejecting compacted waste;

a waste storage compartment mounted on the roll-off base and having a horizontal opening for receiving compacted waste ejected from the compaction chamber; and a shredder unit connected to the compaction unit such that shredded waste passes through the upper opening of the compaction unit into the compaction chamber.

2. The roll-off shredding compactor of claim 1, wherein the compaction unit includes a horizontally-acting hydraulic ram to compact waste within the compaction chamber.

3. The roll-off shredding compactor of claim 1, further comprising a pull-out bar connected to the waste storage compartment for receiving a hook of a winch of a transport vehicle, so that the roll-off shredding compactor can be rolled onto the transport vehicle.

4. The roll-off shredding compactor of claim 1, wherein the shredder unit includes a hopper disposed for receiving material to be shredded.

5. The roll-off shredding compactor of claim 4, wherein the hopper includes:

a hopper cover; and a cover opening assembly capable of opening the hopper cover, the cover opening assembly comprising one of a hydraulic actuator, a chain drive, and a rod lift assembly.

6. The roll-off shredding compactor of claim 5, further comprising:

a bin lift and dump unit connected to the control panel; and a control panel operable to control operation of the shredder unit, the compactor unit, the bin lift and dump unit, and the cover opening assembly, wherein the control panel is adapted to automatically activate the cover opening assembly to open the cover before activating the bin lift and dump unit.

7. The roll-off shredding compactor of claim 1, wherein the shredder unit includes a single-shaft rotary shredder having a rotor with cutters rigidly mounted thereon.

8. The roll-off shredding compactor of claim 1, wherein the shredder unit includes a hydraulic drive coupled to the rotor of the shredder and operable to receive pressurized hydraulic fluid and drive the rotor.

9. The roll-off shredding compactor of claim 1, wherein the waste storage compartment includes at least one door that allows shredded material to be discharged.

10. The roll-off shredding compactor of claim 1, further comprising a bin lift and dump unit.

11. The roll-off shredding compactor of claim 1, further comprising a control panel operable to control operation of the shredder unit and compactor unit.

12. The roll-off shredding compactor of claim 11, further comprising a bin lift and dump unit connected to the control panel, wherein the control panel is adapted to activate the bin lift and dump unit a predetermined plurality of times before automatically activating the compaction unit.

13. A method of operating a self-contained roll-off shredding compactor having a roll-off base, a shredding unit including a shredder motor, a compaction unit having a hydraulic ram and including a compaction chamber, and a waste storage compartment, comprising the steps of:

activating the shredder motor in the shredder unit, such that when waste is inserted into the shredder unit, the waste is shredded by the shredder unit and deposited into the compaction chamber;

deactivating the shredder motor; and cycling the hydraulic ram in the compaction unit to compact the shredded waste and eject the compacted waste into the waste storage compartment.

14. The method of claim 13, wherein the method further comprises:

automatically inserting waste into the shredding unit by activating a bin lift and dump unit capable of lifting a bin containing waste material and dumping its contents into the shredder unit.

15. The method of claim 14, wherein the shredding unit includes a hopper and a hopper cover connected to a means for opening and closing the hopper cover, and the method further comprises:

before inserting waste into the shredding unit, automatically opening the hopper cover via the means for opening and closing the hopper cover; and after inserting waste into the shredding unit, automatically closing the hopper cover via the means for opening and closing the hopper cover.

16. The method of claim 14, wherein the step of cycling the hydraulic ram is performed automatically after the step of activating a bin lift and dump unit is performed a predetermined number of times.

* * * * *